US006722747B2

(12) United States Patent
House, II et al.

(10) Patent No.: US 6,722,747 B2
(45) Date of Patent: Apr. 20, 2004

(54) COLLECTIBLE DISPLAY CASE

(76) Inventors: James J. House, II, 157 Elm St. East, Raynham, MA (US) 02767; Erin E. Logan, 157 Elm St. East, Raynham, MA (US) 02767

( * ) Notice: Subject to any disclaimer, the term of this patent is extended or adjusted under 35 U.S.C. 154(b) by 68 days.

(21) Appl. No.: 09/961,558

(22) Filed: Sep. 24, 2001

(65) Prior Publication Data

US 2003/0057809 A1 Mar. 27, 2003

(51) Int. Cl.[7] ..... A47F 3/00
(52) U.S. Cl. ..... 312/114; 312/224
(58) Field of Search ..... 312/114, 224, 312/204; 206/775, 776; 220/602, 662

(56) References Cited

U.S. PATENT DOCUMENTS

| | | | | |
|---|---|---|---|---|
| 201,756 A | | 3/1878 | Dealy | |
| 670,404 A | * | 3/1901 | Davis | 312/114 |
| 747,442 A | | 12/1903 | Latshaw | |
| 1,793,050 A | * | 2/1931 | Brunhoff | 312/114 |
| 4,553,680 A | | 11/1985 | Griggs et al. | |
| 4,695,929 A | * | 9/1987 | Smith | 312/227 |
| 4,750,793 A | * | 6/1988 | Rioux, Sr. | 312/114 |
| 4,967,953 A | | 11/1990 | Sugawara | |
| D351,075 S | | 10/1994 | Rubin et al. | |
| D351,518 S | * | 10/1994 | Burgess | D6/470 |
| 5,380,080 A | | 1/1995 | Rubin et al. | |
| 5,611,432 A | * | 3/1997 | Dods | 206/459.5 |
| 5,733,021 A | | 3/1998 | O'Neill et al. | |
| 5,868,249 A | * | 2/1999 | Ehnert | 206/775 |
| 6,079,561 A | * | 6/2000 | Burkard | 206/461 |
| 6,237,772 B1 | * | 5/2001 | LaMarche et al. | 206/470 |
| 6,494,763 B1 | * | 12/2002 | Hastey | 446/376 |

FOREIGN PATENT DOCUMENTS

| | | | | |
|---|---|---|---|---|
| JP | 02191164 | * | 7/1990 | 312/114 |
| JP | 04187109 | * | 7/1992 | 312/114 |

* cited by examiner

*Primary Examiner*—Lanna Mai
*Assistant Examiner*—Hanh V. Tran
(74) *Attorney, Agent, or Firm*—John P. McGonagle

(57) ABSTRACT

A transparent case with a collectible positioned over an angled mirror element thereby presenting the collectible for viewing, top and bottom, front and back, and from side to side without the necessity of removing the collectible from the display case.

4 Claims, 2 Drawing Sheets

COLLECTIBLE DISPLAY CASE

BACKGROUND OF THE INVENTION

This invention relates to display cases, and more particularly, to a display case for a collectible.

Collectibles, such as model automobiles, are presently being produced with very detailed and realistic parts, top and bottom, front and back, and side to side. The values of these automobiles can be very high. Most owners of such collectibles store such collectibles in a storage or display case. With today's storage or display cases, the owner of such a collectible must remove the collectible from the case in order to present the collectible's detail. This results in a risk of dropping the collectible as well as soiling the collectible with hand and finger prints.

There are many display cases disclosed in the prior art. However, nearly all such cases are adapted to display a particular product or type of product. What is presently needed is a display case for presenting a collectible for viewing, top and bottom, front and back, and from side to side without the necessity of removing the collectible from the display case.

SUMMARY OF THE INVENTION

The present invention provides a case for displaying and storing collectibles. Such a display case presents a collectible for viewing, top and bottom, front and back, and from side to side without the necessity of removing the collectible from the display case. The display case of the present invention accomplishes this by providing a transparent case with the collectible positioned over an angled mirror element. The present invention thereby meets its primary objective of displaying a collectible from all sides, top and bottom, without having to remove the collectible from the case.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
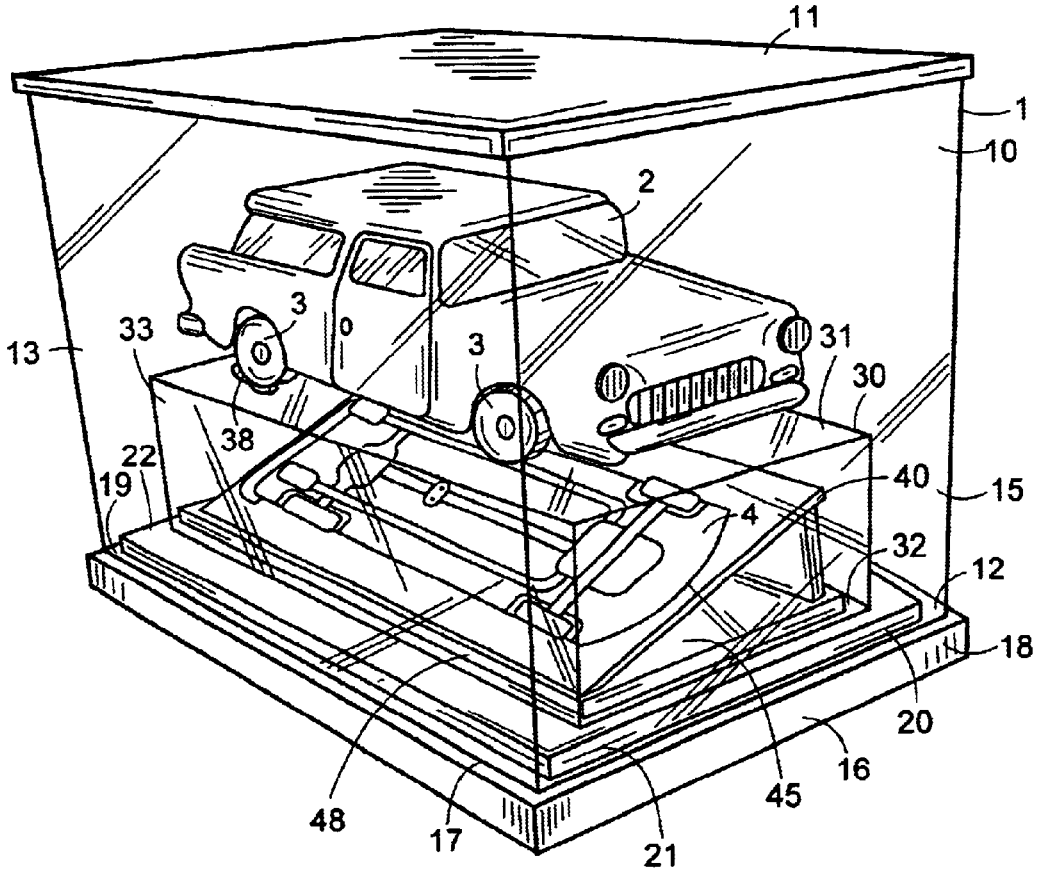
FIG. 1 is a perspective view of the invention.
Figure 2:
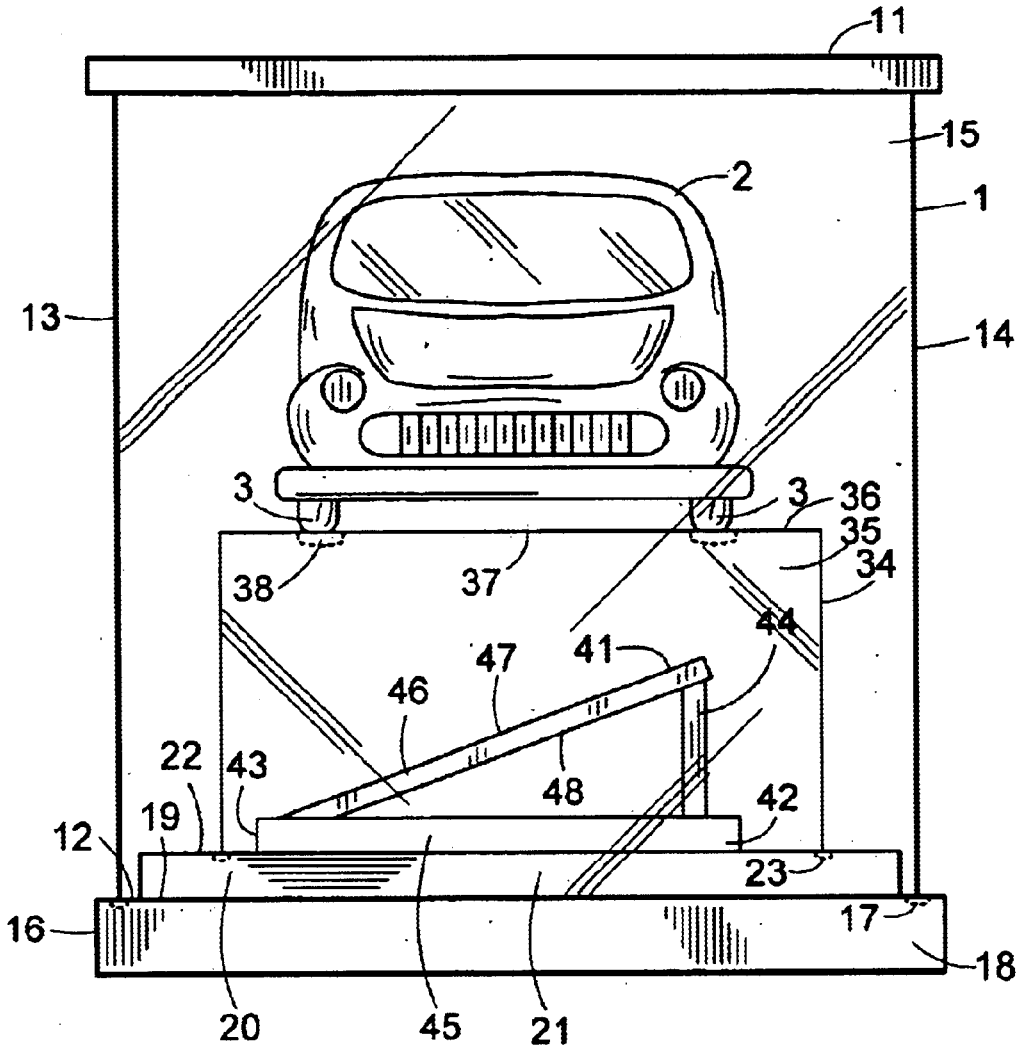
FIG. 2 is a side view of the invention.

Referring to the drawings in detail wherein like elements are indicated by like numerals, there is shown a collectible display case 1 constructed according to the principles of the present invention. The collectible display case 1 is comprised of a mirror platform 40 within a hollow, transparent, inner case 30 within a hollow, transparent, outer case 10.

The outer case 10 has a transparent top 11, an opaque bottom 12, a transparent front 13, a transparent rear 14, and two transparent sides 15. In this embodiment of the invention 1, the outer case 10 has a generally rectangular cubical shape. The outer case bottom 12 is comprised of a generally rectangular base 16 having an upper surface 19 facing the case top 11, said base upper surface 19 having channels 17 formed along the base periphery 18, said channels 17 adapted to receive the outer case front 13, rear 14 and sides 15 in removable engagement.

In an alternate embodiment of the outer case 10, the base 16 may have a flat, generally rectangular pedestal 20 formed thereon, and attached centrally to said base upper surface 19, said pedestal 20 having a periphery 21 extending nearly to the base periphery 18. The pedestal 20 has an upper surface 22 facing the outer case top 11. The pedestal 20 is adapted to having its periphery 21 fit snugly against the outer case front 13, rear 14 and sides 15. The pedestal 20 may have channels 23 formed on its upper surface 22 parallel to the pedestal periphery 21.

The inner case 30 has a transparent top 31, an open bottom 32, a transparent front 33, a transparent rear 34, and two transparent sides 35. In this embodiment of the invention 1, the inner case 30 has a generally rectangular cubical shape. The inner case bottom 32 removably rests on the outer case bottom 12. In an alternate embodiment, the outer case pedestal channels 23 are adapted to receive the inner case front 33, rear 34 and sides 35 in removable engagement. The inner case top 31 has an upper surface 36 and a bottom surface 37, said bottom surface 37 facing the outer case bottom 12. The top upper surface 36 optionally has a plurality of shallow indentations 38 formed therein. In the case where the collectible is a miniature automobile 2, there are four indentations 38, each positioned and adapted to partially receive one of the automobile's wheels 3. The purpose of the indentations 38 are to provide a means for holding the miniature automobile 2 in place on the inner case top 31.

The mirror platform 40 has a top 41, an opaque bottom 42, a front 43, a raised rear 44, and two sides 45. The mirror platform 40 has a generally rectangular mirror element 46 extending from the rear top 44, 41 to the bottom front 42, 43. The mirror element 46 has a reflective upper surface 47 and an opaque, non-reflective, opposite lower surface 48.

In operation, the mirror platform 40 is positioned on the outer case bottom 12 or outer case pedestal 20. The inner case 30 is positioned over the mirror platform 40 onto the outer case bottom 12 or outer case pedestal 20. A collectible, such as a miniature automobile is placed on the inner case top upper surface 36 so that the automobile wheels 3 engage the upper surface indentations 38. The outer case 10 is then positioned over the inner case 30 in engagement with the outer case bottom 12. The entire upper surface of the automobile 2 is visible. As is apparent from the drawings, a reflection 4 of the automobile under carriage is visible on the mirror element reflective upper surface 47.

It is understood that the above-described embodiment is merely illustrative of the application. Other embodiments may be readily devised by those skilled in the art which will embody the principles of the invention and fall within the spirit and scope thereof.

We claim:

1. A case for displaying and storing collectibles, comprising:

a transparent, hollow, outer case having a top, a bottom, a front, a rear, and two sides; and a mirror platform within a hollow, transparent, inner case within said outer case;

wherein, the inner case has a transparent top, an open bottom, a transparent front, a transparent rear, and two transparent sides, wherein the inner case bottom removably rests on the outer case bottom;

wherein, the mirror platform has a top, an opaque bottom, a front, a raised rear, and two sides, and a generally rectangular mirror element extending from the mirror platform rear to the front, said mirror element having a reflective upper surface and an opaque, non-reflective, opposite lower surface.

2. A case for displaying and storing collectibles, as recited in claim 1, wherein:

said inner case top has an upper surface and a bottom surface, said bottom surface facing the outer case bottom;

said top upper surface has a plurality of shallow indentations formed therein.

3. A case for displaying and storing collectibles, as recited in claim 2, wherein:

the outer case bottom is comprised of a generally rectangular base having a periphery and an upper surface facing the case top, said base upper surface having channels formed along the base periphery, said channels adapted to receive the outer case front, rear and sides in removable engagement.

4. A case for displaying and storing collectibles, as recited in claim 3, wherein:

the pedestal has an upper surface facing the outer case top and a plurality of channels formed on said upper surface parallel to the pedestal periphery, said channels being adapted to receive the inner case front, rear and sides in removable engagement.

* * * * *